United States Patent [19]

Grise et al.

[11] 4,031,836

[45] June 28, 1977

[54] MACHINE FOR MAKING CAN ENDS HAVING RUPTURABLE CLOSURES

[76] Inventors: Frederick Gerard Joseph Grise, 87 Main St., Osterville, Mass. 02655; Walter Carl Lovell, 348 Mountain Road, Wilbraham, Mass. 01095

[22] Filed: Apr. 16, 1976

[21] Appl. No.: 677,798

[52] U.S. Cl. ..... 113/1 F; 113/121 C

[51] Int. Cl.[2] ..... B21D 51/44

[58] Field of Search ..... 113/1 F, 15 A, 121 C; 72/353, 354, 356, 465; 220/268

[56] References Cited

UNITED STATES PATENTS

| | | | |
|---|---|---|---|
| 2,136,933 | 11/1938 | Calleson | 113/1 F |
| 2,434,375 | 1/1948 | Van Saun | 113/121 C |
| 3,580,200 | 5/1971 | Cvacho | 113/1 F |
| 3,760,752 | 9/1973 | Geiger | 113/121 C |
| 3,768,295 | 10/1973 | Cudzik | 113/1 F |
| 3,881,437 | 5/1975 | Lovell | 113/121 C |
| 3,967,751 | 7/1976 | Gane et al. | 220/68 |

*Primary Examiner*—Michael J. Keenan
*Attorney, Agent, or Firm*—Carl E. Johnson; Richard B. Megley; Vincent A. White

[57] ABSTRACT

In a punch press for making metal can tops with closures, respectively, especially those closures of easy-open construction involving an integral but fractured section, cooperative dies are caused in each cycle to perform at a single station first a forming operation, then a peripheral coining step, preferably during the last phase of the forming, and lastly a primary and a secondary swaging or "fracture sealing" operation, the latter occurring as the dies separate. The invention, though not so limited, is applicable to production of can tops of the type disclosed in U.S. Letters Pat. No. 3,881,630, for example, and has particular merit in enabling can top production to occur largely at a single station. It thus conserves manufacturing space as well as lowers cost.

8 Claims, 9 Drawing Figures

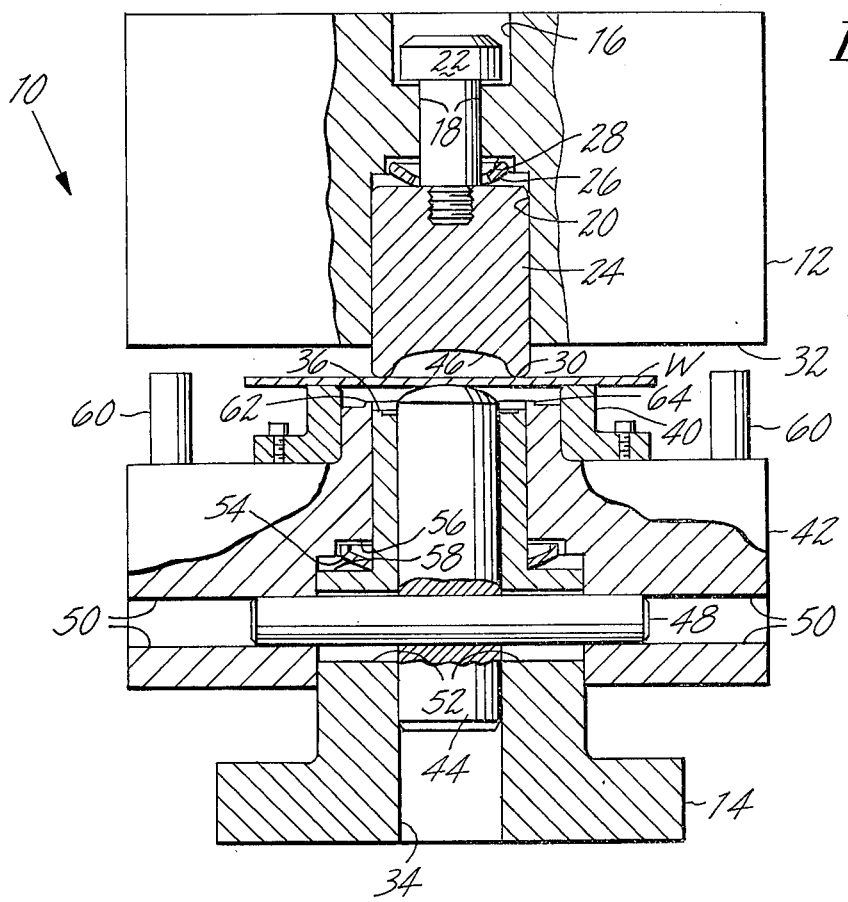
Fig. 1
Fig. 2
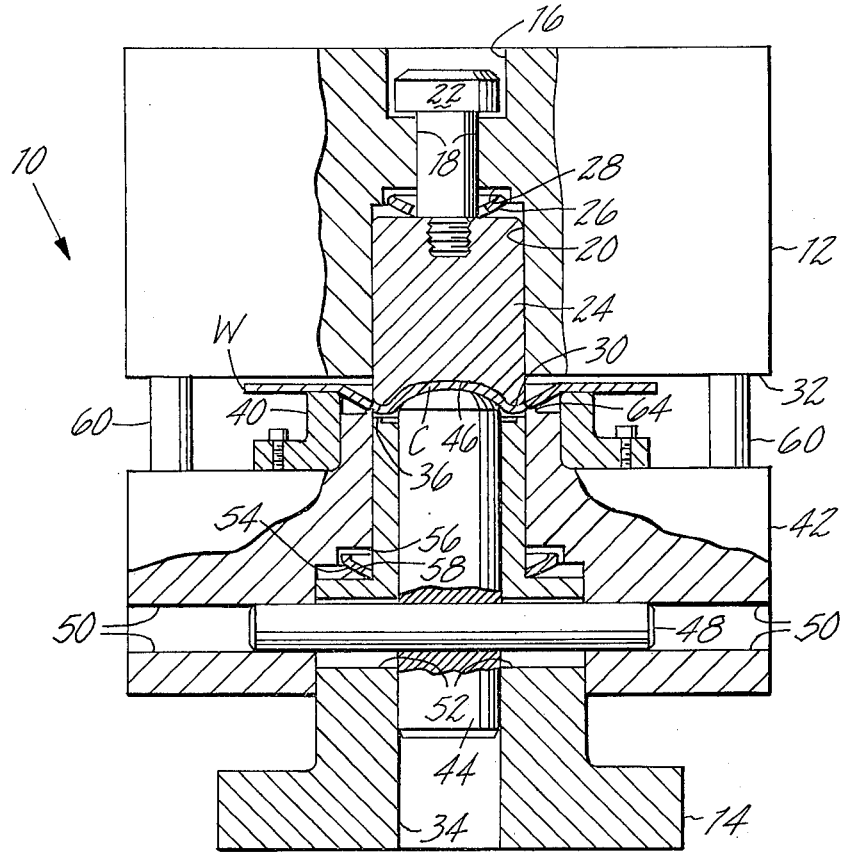

MACHINE FOR MAKING CAN ENDS HAVING RUPTURABLE CLOSURES

Cross Reference to Related Applications

The method of making "Pop-in" can closures of the patented type referred to, and which may be practiced by machines embodying the present invention is disclosed in an application for U.S. Pat., Ser. No. 454,384, now U.S. Pat. No. 3,881,437 filed Mar. 25, 1974 in our names. Also, our application, Ser. No. 494,985 filed Aug. 8, 1974 and now Pat. No. 3,981,652 pertains to "Machines for Partly Coating Articles", and a United States Application, Ser. No. 574,643 filed May 5, 1975, now U.S. Pat. No. 4,006,700, in our names pertains to a method for making weakening lines which is applicable to "easy-open" can ends.

BACKGROUND OF THE INVENTION

Mass production of easy-open sheet metal containers and/or can tops is commonly effected by a series of steps performed at successive punch press type stations. In one typical arrangement, for instance, an endless flexible steel belt is employed as the work feeding means for carrying successive can top blanks through a multiple station line, each station including, for instance, Stolle-minster of a Bliss type (or the like) press having appropriate tools, dies and/or treating means whereby forming and processing is accomplished sequentially. Such a system generally operates at high speed, occupies considerable floor space, and is quite costly. It is accordingly desirable to be able to introduce into such a production line, without interference with operations at other stations, a single station whereat all (or a large number of) the steps for making disruptible closures may be performed.

A few representative disclosures indicative of the highly developed arts of sheet metal forming and container-making machinery are to be found, for example, in U.S. Pat. Nos. 3,871,314, 3,683,834 and 3,768,295.

In view of the foregoing it is a primary object of this invention to provide an improved relatively inexpensive punch press for making easy-open can ends in a single station, the necessary steps in production all occurring within appropriate portions of each cycle of operations.

Another object of this invention is to provide a one-station machine for successively forming, coining, and swaging sheet metal to produce can tops having disruptible closures, especially closures integral with the can tops, respectively.

More specifically, it is an object of this invention to provide an efficient, relatively economical, one-station machine for cyclically producing substantially completed sheet metal container ends including manually rupturable closures defined by fractured but integral peripheral portions.

To these ends, and as herein illustrated, the invention resides in incorporating in a container end or cover making station, means operative during a cover making cycle to predeterminedly form, partially shear-coin, and then swage the rim of a closure. This is to say that, when each sheet metal end blank has been presented to be peripherally formed as by a die movable relative to another and usually complemental fixed die, a plurality of closure-forming tools partaking of the relative motion of the cover forming dies in each cycle is arranged and adapted to sequentially define and make disruptible a closure integral with each cover. Thus, the periphery of each closure is at least partly formed and shear-coined to provide a predetermined line of weakening (often an ingegral yet fractured line), and the closure is thereupon swaged to cause its peripheral margin to be radially dilated with respect to the cover, the dilated margin thus being urged into sealing relation to frangibly lock the closure to the cover at the line of weakening. Accordingly, each container end is not only formed at one station, but each end emerges from the same station with its disruptible closure completed and ready for coating, if needed, preparatory to assembly with a can body. A separate closure making station is not generally required, but it will be appreciated that, should it be desired, the closure making means herein disclosed may be operated at another station of a production line or independently thereof.

BRIEF DESCRIPTION OF THE DRAWINGS

The foregoing and other features of the invention will now be more particularly described in connection with an illustrative and preferred embodiment of a machine for making sheet metal can ends having peripherally fractured closures integral therewith, and with reference to the accompanying drawings thereof in which:

FIG. 1 is a view in elevation of a portion of a punch press with portions broken away to show closure forming parts including spring-backed forming and coining tools in axial section, the parts being in their initial rest positions with respect to a presented can end blank to be processed;

FIG. 2 is a view similar to FIG. 1, but with the parts at a next stage in a cycle wherein, a lower swaging die remaining stationary, closure forming has largely been effected and stops have limited coin-shearing of the closure periphery to provide a circumferential indentation and fractured weakening line;

DESCRIPTION OF PREFERRED EMBODIMENTS

Figure 8:
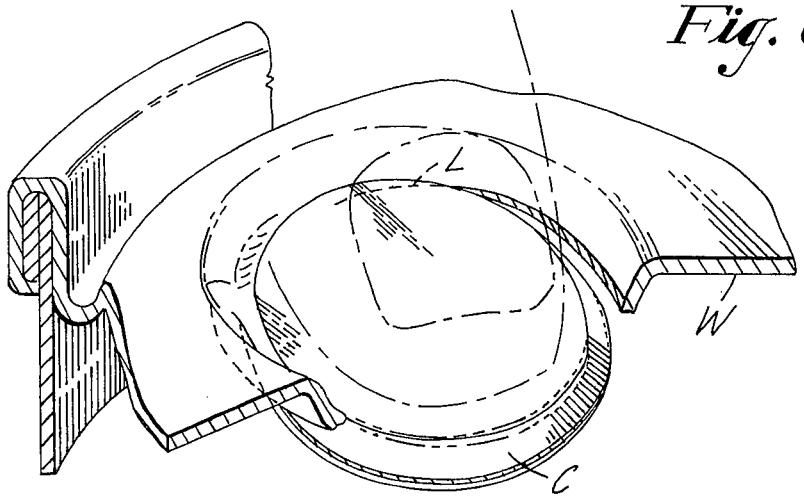
FIG. 8 is a perspective view showing an exemplary digitally rupturable can lid, with portions broken away, as made by the mechanism and steps illustrated in FIGS. 1—4

In the drawings, FIGS. 1—7 illustrate our invention as embodied in punch press type mechanism generally designated 10 for cyclically producing from work piece blanks W container ends having manually rupturable closures C. The container ends as well as their closures, it will be understood, may be produced by the mechanism when operating in accordance with the invention in a great variety of sizes and configurations, one typical sheet metal can end and its closure C produced by the illustrative mechanism being shown in FIG. 8. Details of this particular can end are disclosed in the above-cited U.S. Pat. No. 3,881,630, but it will be appreciated that the present invention is not restricted in use to manufacture of can ends covered by that patent.

Referring to FIGS. 1–4, a vertically reciprocable die holder 12 is mounted for relative movement with respect to a stationary, lower forming and swaging die 14. The die holder 12 is formed with vertically extending, interconnected bores 16, 18 and 20 for slidably supporting a headed bolt 22 threadedly connected to an upper forming die 24. A compression spring 26, preferably of the conical type sometimes termed Belleville, is seated in an inner cavity 28 in the holder 12 and engages an end surface of the die 24 in the bore 20 thereby urging the die 24 downwardly to the extent permitted by engagement of the bolt head with an inner shoulder of the bore 16. The lower end of the upper forming die is formed with a closure-defining surface which in this instance comprises an annular, transversely convex ridge 30 projecting from a flat undersurface 32 of the holder 12. As herein shown the upper forming die 24 is substantially coaxial with a vertically disposed bore 34 formed in the lower swaging die 14.

For purposes later described the rounded ridge 30 has an outer diameter substantially corresponding to the inner diameter of the upper portion of the swaging die 14. More particularly, the periphery of the upper end of the die 14 is formed with an annular swaging surface 35 adapted, as indicated in FIGS. 3 and 6, to cold work the blank W to one side (either inside or outside, in this case outside) of the apex of a ridge R to be formed and coined therein, as later explained.

The blank W, as shown in FIG. 1, is initially located by any suitable means on a stripper or forming ring 40 secured onto the upper surface of a coining tool 42. The latter is telescopically mounted on the fixed swaging die 14 (usually coaxial with its bore 34) for relative yielding movement heightwise. To this end an inner forming die 44 having a domed upper work-shaping end arranged to be received in a complemental recess 46 in the upper die 24 is fixedly secured to the coining tool 42 by means of a coupling pin 48. This pin 48 extends through a transverse bore of substantially the same diameter formed in the forming die 44, and likewise through aligned bores 50, 50 in the coining tool 42. Aligned transverse bores 52, 52 in the swaging die 14, however, are of greater diameter than that of the pin 48 thus permitting limited relative heightwise displacement jointly of the die 44 and the coining tool 42 with respect to the swaging die. Hence, a compression spring 54, again preferably of the conical (Belleville) type, and weaker than the spring 26, nested between an inner shoulder 56 on the coining tool 42 and an outer shoulder 58 of the swaging die 14, will be compressed as the upper forming die 24 descends during relative movement of approach of the die holder 12 and the swaging die 14.

Figure 3:
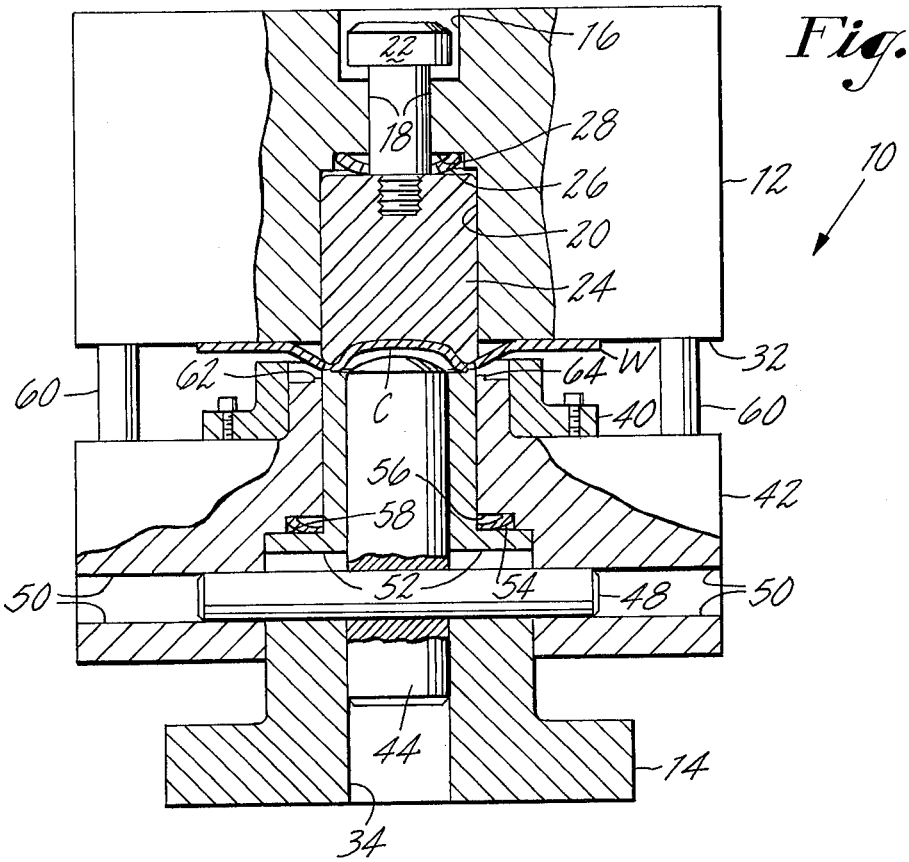
FIG. 3 is a view like FIGS. 1 and 2, but showing the parts at a subsequent stage in the cycle wherein, the coining tool being depressed against its spring via the stops, the fixed lower swaging-die acts circumferentially on the closure rim to dilate a face of the indentation as the upper forming die bottoms.
Figure 4:
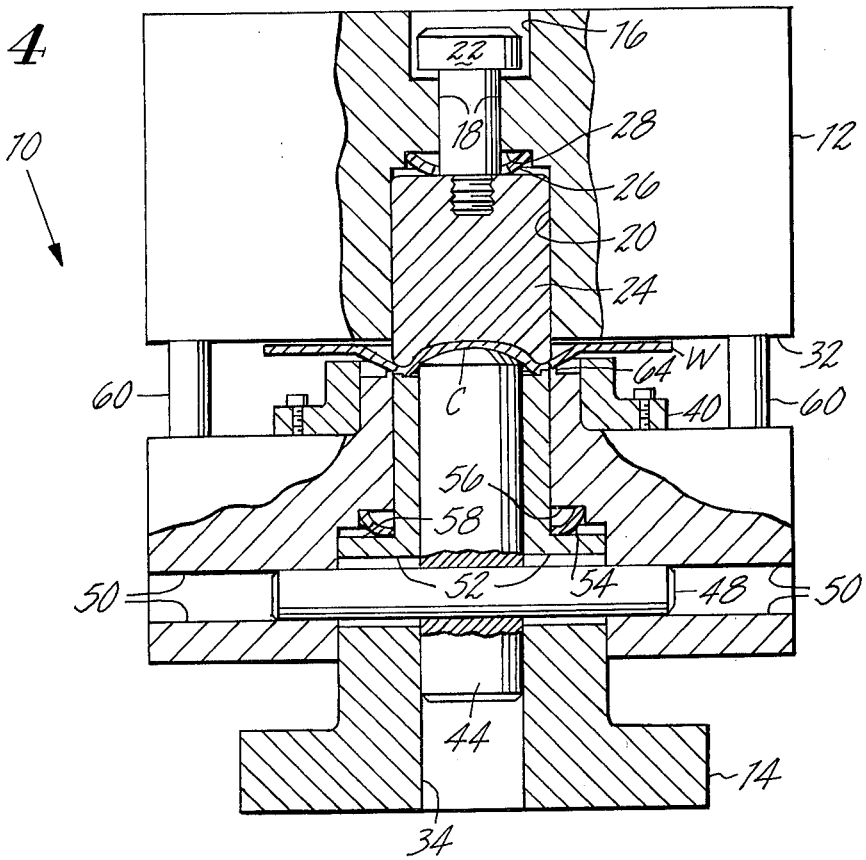
FIG. 4 is a view similar to FIGS. 1–3 inclusive, but showing a next stage wherein relative retraction of the upper die holder allows the coining tool to impart a final swaging effective on the dilated closure rim to tend to lock the rupturable closure to the adjacent edge of the can end.

The extent of approach of the holder 12 and the coining tool 42 is limited as indicated in FIGS. 2–4 by stop means, herein shown as at least a pair of laterally spaced, upright pins 60, 60 preferably adjustably threaded endwise into the coining tool 42 and arranged to abut the surface 32 of the holder 12. Thus, as the parts are shifted from their respective starting positions in the course of a cycle, i.e. from those indicated in FIG. 1 to those forming and coining positions shown in FIGS. 2 and 5, angularly related, circumferential coining faces 62, 64 (FIG. 5) of the tool 42 (initially projecting above the swaging surface 36) are enabled to peripherally indent the margin external to the closure C in that ridge portion 30 of the blank W then being simultaneously subjected to tension and forming. That is to say, in shifting from the positions shown in FIG. 1 to those of FIGS. 2 and 5, an integral but (nearly or actually) fractured line L of weakening is effected by the faces 62, 64 to define the closure C, the weaker spring 54 becoming partly loaded as the coining is completed.

Figure 5:
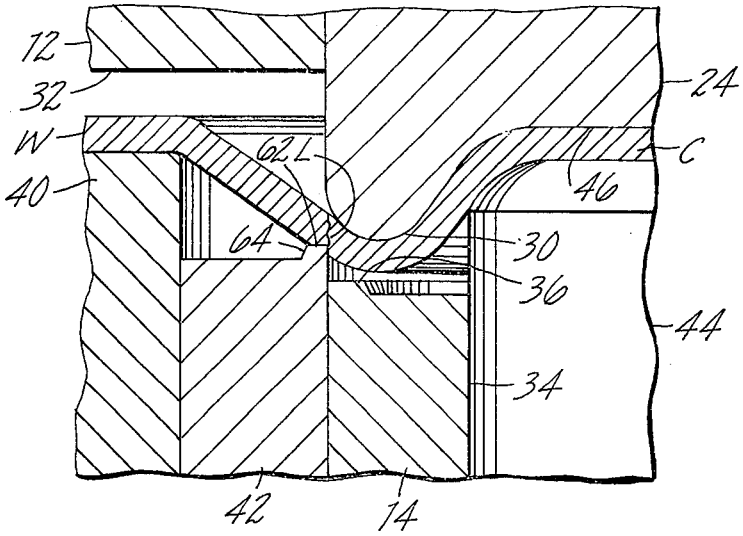
FIG. 5 is an enlarged axial section corresponding to a portion of FIG. 2 and showing shear-coining to the point of fracture of the closure perimeter.
Figure 6:
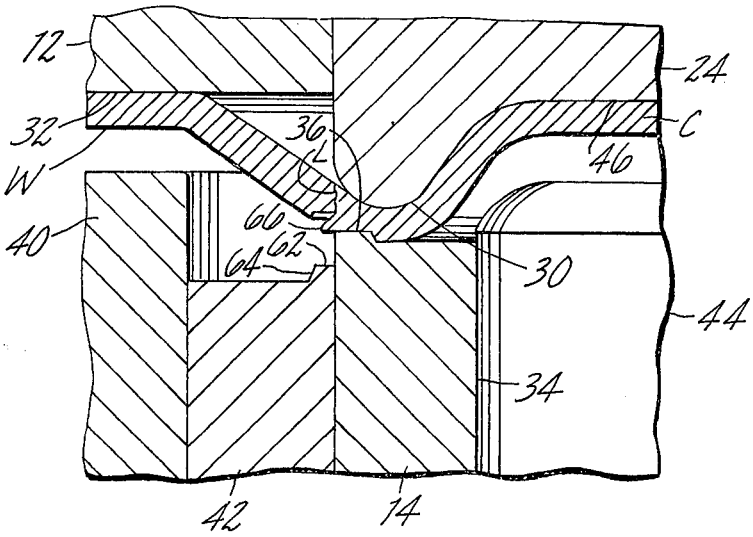
FIG. 6 is an enlarged section similar to FIG. 6 but showing the initial swaging as next occurring in FIG. 3.
Figure 7:
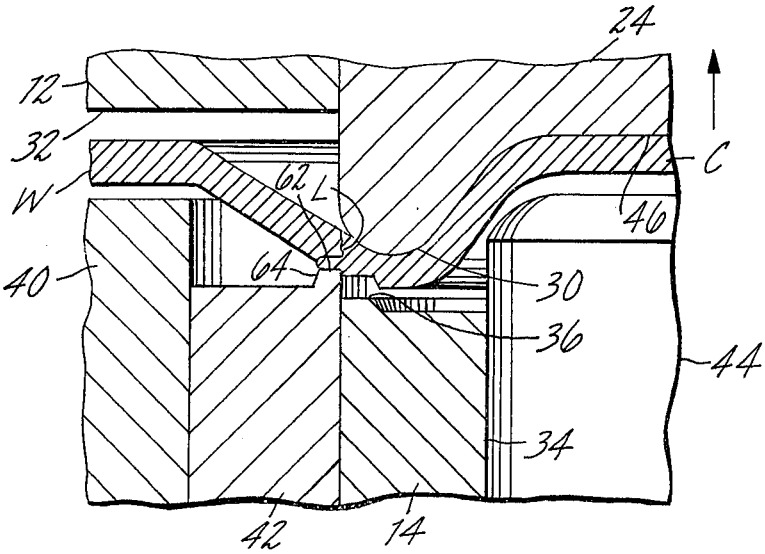
FIG. 7 is a section as in FIGS. 5 and 6 but showing the final swaging occurring as shown in FIG. 4.

Next in the cycle, as the parts shift from their relative positions indicated in FIGS. 2 and 5 wherein stops 60 had engaged the surface 32 to those shown in FIGS. 3 and 6, the weaker spring 54 becomes fully loaded as the coining tool 42 and the die 44 jointly descend until coupling pin 48 bottoms in the bores 52 of the swaging tool. The holder 12 in completing its relative descent with respect to the swaging tool 14 has acted through the stop pins 60 to relatively lower the coining tool 42 yieldingly and now enables the swaging surface 36 (FIG. 6) to dilate outwardly material from the ridge 30 thus to enlarge the perimeter of the closure C in overlapping or sealing relation (as best shown at 66 in FIG. 6) to the weakening line L which has just been created. It will be understood that details in the several figures are not truly proportional to actual dimensions, and that for clarification purposes a number of the very small features dimensionally are shown magnified.

Lastly, the holder 12 having reversed its descent and started its relative upward separation from the swaging tool 14 (as indicated by the vertical arrow in FIG. 7) to return toward the starting position of the cycle being described, the compressed spring 54 is allowed by decompression of the spring 26 to deenergize. This consequently now causes the coining tool 42 to be raised relatively to the swaging tool 14. Hence, the coining surface 62 now engages with impact the just dilated rim material 66 of the closure C thereby effecting a secondary swaging for urging that material into more effective overlapping relation to the fractured weakening line L, and at least to some extent tightening the interlocking and sealing which had been caused earlier by the primary swaging. It will be appreciated that the substantially simultaneous closure forming and coining operations have thus, within a single cycle of the punch press mechanism described, been followed by a primary swaging action of the surface 36 to close the fractured weakening line L by dilating the metal under tension, and then a final impacting or secondary swaging directed by the surface 62 against the dilated closure rim. This last step ensures that, though the line L has been fractured, its probably jagged mating metal edges are forced into a substantially fluid tight interlocking that nevertheless may be substantially manually disrupted as by digital pressure.

From the foregoing, its is believed both construction and sequential operation of the machine will be understood. The die 24, in addition to providing forming of the closure, plays a continuous backing role to ensure continuous positioning control of the cover as its metal is cold worked. Suitable ejection means (not shown) functions prior to the next cycle to remove the can end W prior to reloading of the station described.

Figure 9:
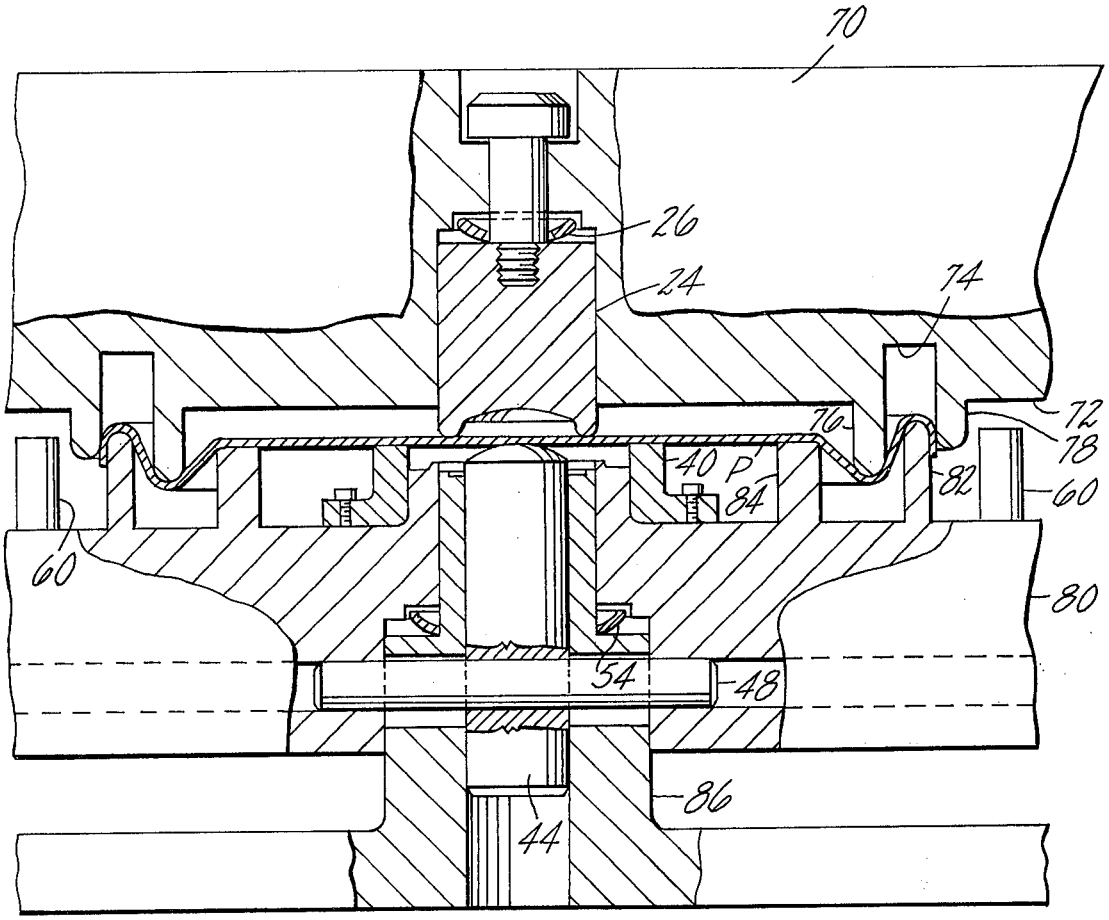
FIG. 9 is a sectional view similar to FIG. 1 but more fully indicating a cooperating die holder and coining tool which are adapted to form, as from continuous sheet stock, a representative outer periphery of a can end as well as simultaneously and cyclically produce a fractured closure therein according to the invention.

In FIG. 9 mechanism similar to that shown in FIG. 1 is illustrated, except that means for forming a full can end panel P is shown in an initial position wherein the outer rim is being formed just prior to closure forming. It may, for instance, have been peripherally cut out from continuous sheet stock instead of being received as a pre-cut disc or discrete end panel. In this instance a combination die and die holder 70 carries an upper forming die 24 in the manner described above, and its undersurface 72 is formed with an annular recess 74 bounded internally by a downwardly projecting rib 76 and externally by a rib 78. A cooperative coining tool 80 (corresponding to the tool 42) is provided with stop pins 60, 60 a forming ring or ejector 40, and an outer forming ring 82 arranged to engage the panel P between the ribs 76, 78 when an inner forming ring 84 engages the panel to form an annular trough therein by bending the panel over the rib 76. As thus held taut, the holder 70 cyclically reciprocates vertically with respect to the tool 80 in the manner above indicated with reference to the tool 42, and likewise relative to a stationary swaging die 86 (corresponding to the mentioned swaging die 14). The corresponding parts 44, 48, 26 and 54 function essentially as above explained to produce in each cycle a can top formed with closure and ready for assembly with a can body and any appropriate lacquer or sealant.

We claim:

1. A punch press cyclically operable on sheet metal blanks for making container ends respectively including a disruptible closure comprising, an upper die holder relatively movable toward and from a swaging die along a common axis, a spring-backed upper forming die carried by said holder for movement along said axis and having a projecting closure-defining surface, a spring-backed coining tool telescoped on the swaging die for yielding movement between axial limits, a lower forming die coupled to the coining tool, stop means for determining the limit of approach between the upper die holder and the coining tool, a stripper mounted on the coining tool, and power means for causing the upper die holder to force the upper forming die against a blank on the stripper and into cooperative relation with the lower forming die whereby the periphery of the end closure is formed and, as the limit of approach is about to be determined by said stop means, to cause the coining tool to produce a line of weakening along at least a portion of said formed periphery, the spring-backing of the upper forming die providing a greater resistance to unit load than the spring-backing of the coining tool so that bottoming of the upper forming die permits the loaded swaging die to cooperate with said projecting surface to radially dilate the closure periphery adjacent to said line of weakening, and thereafter relative retraction of the upper die holder in the operating cycle permits the still loaded coining tool to be de-energized and cooperate with said closure-defining surface of the upper forming die to tend to lock said dilated periphery to the remainder of the blank.

2. A press as in claim 1 wherein the stop means is adjustably secured to said coining tool to enable the coining tool to effect a fractured but integral section in a blank at said line of weakening.

3. A press as in claim 1 wherein at least one of the upper forming die and the coining tool is backed by one or more initially coned springs.

4. A press as in claim 1 wherein the lower forming die is coupled to the coining tool by means of a pin, and the latter extends through a bore formed transversely in the swaging die, said bore having a diameter greater than that of the pin.

5. A press as in claim 4 wherein the swaging die is held stationary.

6. In a container cover making machine comprising a pair of dies relatively movable together and apart cyclically to form covers from sheet material, a plurality of disruptible closure making tools respectively associated with said dies in yieldable relation coaxially, certain of said tools being adapted cooperatively to form a disruptible closure defined by a predetermined line of weakening in each cover as the dies approach one another, means for dilating rim material of the closure, and one of said tools including a surface operable as the dies separate to urge said dilated rim material of the closure into frangible sealing relation with the cover.

7. A machine as in claim 6 wherein the closure making tools include in telescoping, relatively yieldable relation a tool having a coining face operable in a path closely adjacent to the path of a swaging surface formed on said dilating means, and the mounting of the tool is such that its coining face effects a secondary swaging upon the material dilated by said surface in a primary swaging operation.

8. A can cover making machine comprising, in coaxial relation, a primary swaging die and a die holder relatively movable together and apart, a closure forming die having a ridge and yieldably mounted on the die holder for limited relative axial movement, a coining tool having a coining face and yieldably mounted on the swaging die for limited relative axial movement in response to operation of the closure forming die, a drawing die carried by the coining tool for cooperation with the closure forming die during coining of a cover by said face acting against said ridge, adjustable stop means limiting relative approach of the die holder and the coining tool to enable the coining face to predeterminedly form a weakening line defining the closure, and power means for cyclically operating the machine, the arrangement being such that, following operation of the primary swaging die tending to dilate metal along said weakening line of the closure formed by the forming dies, the coining tool acts in the same cycle to secondarily swage the dilated metal into tightened interlocking relation at said weakening line.

* * * * *